US010760164B2

(12) United States Patent
Ding et al.

(10) Patent No.: US 10,760,164 B2
(45) Date of Patent: Sep. 1, 2020

(54) TWO-STEP SEALING OF ANODIZED ALUMINUM COATINGS

(71) Applicant: Hamilton Sundstrand Corporation, Charlotte, NC (US)

(72) Inventors: Zhongfen Ding, South Windsor, CT (US); Weilong Zhang, Glastonbury, CT (US); Blair A. Smith, South Windsor, CT (US); Mark R. Jaworowski, Sarasota, FL (US); Georgios S. Zafiris, Glastonbury, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 16/226,042

(22) Filed: Dec. 19, 2018

(65) Prior Publication Data

US 2019/0127860 A1 May 2, 2019

Related U.S. Application Data

(63) Continuation-in-part of application No. 15/344,351, filed on Nov. 4, 2016, now abandoned.

(51) Int. Cl.
*C23F 11/18* (2006.01)
*C23C 22/17* (2006.01)
(Continued)

(52) U.S. Cl.
CPC ..... *C23F 11/184* (2013.01); *C23C 22/10* (2013.01); *C23C 22/17* (2013.01); *C23C 22/42* (2013.01);
(Continued)

(58) Field of Classification Search
CPC ..... C23C 2222/10; C23C 22/10; C23C 22/17; C23C 22/42; C23C 22/83; C23F 11/124;
(Continued)

(56) References Cited

U.S. PATENT DOCUMENTS 4,828,615 A * 5/1989 Cape ..... C23C 22/83 106/14.13
5,374,347 A 12/1994 Pearlstein et al.
(Continued)

FOREIGN PATENT DOCUMENTS

WO 2016116949 A1 7/2016

OTHER PUBLICATIONS

Extended European Search Report for EP Application No. 17200215.6, dated Feb. 7, 2018, 8 pages.

*Primary Examiner* — Shuangyi Abu Ali
(74) *Attorney, Agent, or Firm* — Kinney & Lange, P.A.

(57) ABSTRACT

A method includes providing a workpiece with at least one surface having an anodized aluminum coating and a trivalent chromium sealant. The at least one surface of the workpiece is submerged in a post-treatment sealant solution for 0.5 to 20 minutes. The sealant composition consists essentially of a corrosion inhibitor formulation, a water soluble polymer, an organic complexing agent, and an oxidant. The corrosion inhibitor formulation is formulated from at least one anodic corrosion inhibitor compound, at least one cathodic corrosion inhibitor compound, or a combination thereof. A concentration of each of the corrosion inhibitor formulation, the water soluble polymer, the organic complexing agent, and the oxidant is each in a range of 1-50 mM.

20 Claims, 1 Drawing Sheet

(51) Int. Cl.

| | |
|---|---|
| ***C23C 22/42*** | (2006.01) |
| ***C23C 22/10*** | (2006.01) |
| ***C23F 11/12*** | (2006.01) |
| ***C23F 13/00*** | (2006.01) |
| ***C23F 13/02*** | (2006.01) |
| ***C25D 11/24*** | (2006.01) |
| ***C23C 22/83*** | (2006.01) |

(52) U.S. Cl.
CPC ..... *C23C 22/83* (2013.01); *C23F 11/124* (2013.01); *C23F 11/185* (2013.01); *C23F 13/005* (2013.01); *C23F 13/02* (2013.01); *C25D 11/246* (2013.01); *C23C 2222/10* (2013.01)

(58) Field of Classification Search
CPC .... C23F 11/184; C23F 11/185; C23F 13/005; C23F 13/02; C25D 11/246
See application file for complete search history.

(56) References Cited

U.S. PATENT DOCUMENTS

| | | | |
|---|---|---|---|
| 6,315,823 | B1 | 11/2001 | Dolan |
| 6,471,788 | B1 | 10/2002 | Minevski et al. |
| 2015/0020925 | A1 | 1/2015 | Bares et al. |

* cited by examiner

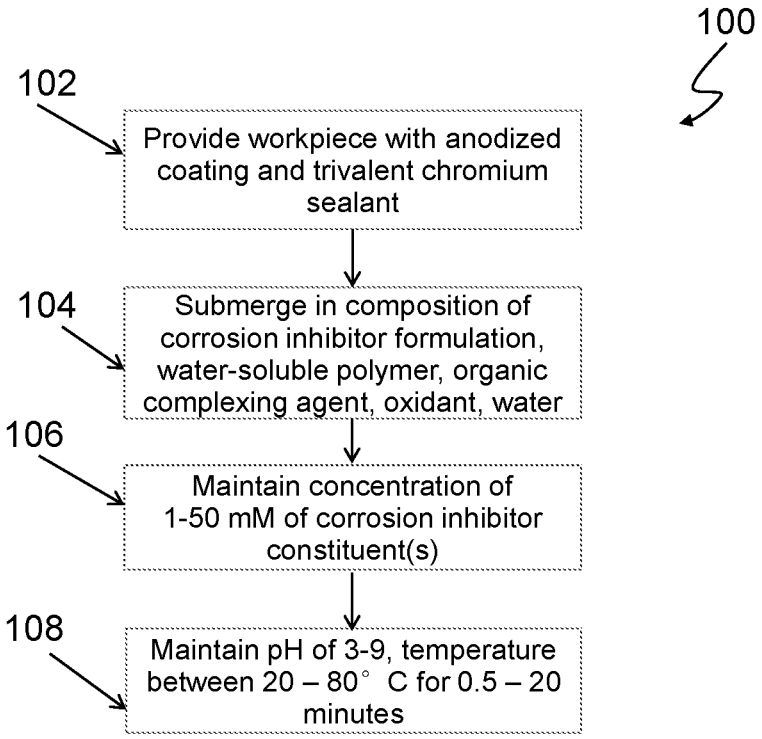
100
102
Provide workpiece with anodized coating and trivalent chromium sealant
104
Submerge in composition of corrosion inhibitor formulation, water-soluble polymer, organic complexing agent, oxidant, water
106
Maintain concentration of 1-50 mM of corrosion inhibitor constituent(s)
108
Maintain pH of 3-9, temperature between 20 – 80° C for 0.5 – 20 minutes

TWO-STEP SEALING OF ANODIZED ALUMINUM COATINGS

CROSS-REFERENCE TO RELATED APPLICATION(S)

This application is a continuation-in-part of U.S. application Ser. No. 15/344,351 filed Nov. 4, 2016, for "Two-Step Sealing of Anodized Aluminum coatings" by Z. Ding, W. Zhang, B. Smith, M. Jaworowski, and G. Zafiris.

BACKGROUND

The disclosed subject matter relates generally to anodized aluminum coatings, and more specifically to sealing and protecting anodized aluminum coatings.

Anodized aluminum coatings, used in a number of industries and applications, have a very thin barrier layer under a more porous main coating structure. To improve corrosion resistance of the coating and substrate, anodized aluminum coatings are often sealed. Conventionally, hexavalent chromium (Hex-Cr) compounds have been used to seal anodized aluminum coatings and improve corrosion resistance. However, Hex-Cr sealants are toxic and carcinogenic and thus are being phased out in favor of more environmentally- and health-friendly compounds.

One common substitute for Hex-Cr includes variants on trivalent chrome process (TCP) sealing. Effective sealing, particularly for TCP sealants requires deep sealant penetration and homogeneous distribution within the anodized coating. A panel with a commercially available trivalent sealing technology can provide reasonable sealing which often can pass the minimum 336 hr neutral salt fog chamber (ASTM B117) test requirement. However, the process still needs to be controlled very strictly according to published procedures to provide suitable opportunity for sealing and yet, the results are often mixed for very thin anodized coatings (<500 mg/ft$^2$). Among other factors, shortening the processing time reduces penetration and effectiveness for each conventional TCP sealing technology.

SUMMARY

A sealant composition consists essentially of a corrosion inhibitor formulation, a water soluble polymer, an organic complexing agent, an oxidant, and water. The corrosion inhibitor formulation is formulated from at least one anodic corrosion inhibitor compound, at least one cathodic corrosion inhibitor compound, or a combination thereof. A concentration of each of the corrosion inhibitor formulation, the water soluble polymer, the organic complexing agent, and the oxidant is each in a range of 1-50 mM.

A method includes providing a workpiece with at least one surface having an anodized aluminum coating and a trivalent chromium sealant. The at least one surface of the workpiece is submerged in a post-treatment sealant solution for 0.5 to 20 minutes. The sealant composition consists essentially of a corrosion inhibitor formulation, a water soluble polymer, an organic complexing agent, an oxidant, and water. The corrosion inhibitor formulation is formulated from at least one anodic corrosion inhibitor compound, at least one cathodic corrosion inhibitor compound, or a combination thereof. A concentration of each of the corrosion inhibitor formulation, the water soluble polymer, the organic complexing agent, and the oxidant is each in a range of 1-50 mM.

BRIEF DESCRIPTION OF THE DRAWINGS

FIG. 1 is a flow chart of an example two-step sealing process.

DETAILED DESCRIPTION

Currently there are a number of commercially available TCP sealing technologies. Examples include CHEMEON TCP-HF™, CHEMEON TCP-NP™, SurTec 650V™, Luster-On Aluminescent™, and Socomore SOCOSURF™ TCS+PACS. While these and other TCP sealants improve properties of an anodized aluminum coating, beyond the relatively thin barrier layer of the anodized coating, the application process for existing TCP sealants must be strictly adhered to. While properly applied TCP sealants can satisfy certain tests, the margin for error is small, and waste and cost are increased due to the need for scrapping or reprocessing of insufficiently sealed anodized coatings. Therefore, a two-step sealing process, combined with a conventional TCP as the first step and the second step using a post-treatment sealant solution as detailed below is described.

Sealing effects of a TCP composition can be improved using a second step, which includes application of a secondary sealant composition according to method 100 in FIG. 1. The process begins with providing a workpiece having at least one surface with an anodized aluminum coating (performed by such methods as chromic acid, boric sulfuric acid, thin film sulfuric acid, sulfuric acid, and/or tartaric sulfuric acid anodizing). The provided workpiece also includes a trivalent chrome sealant applied to the anodized surface(s). The trivalent chrome sealant is the first step of a two-step sealing process disclosed herein, and can be applied at the same facility as the second (post-treatment) sealant composition step. Alternatively, the workpiece can be provided with the TCP sealant already applied, ready for the second (post-treatment) sealant composition step according to method 100.

After providing the workpiece(s) with a TCP-sealed anodized coating (step 102), surface(s) of the workpiece having such a coating are submerged, according to step 104, into an aqueous composition which consists essentially of: a corrosion inhibitor formulation including a plurality of anodic and/or cathodic corrosion inhibitors, an organic complexing agent, a water soluble polymer, an oxidant, and water. Certain embodiments of the composition, however, can also include one or more surfactants to promote wetting, or promote solution stability with certain combinations of corrosion inhibitor(s), organic complexing agent(s), and oxidant(s). Certain areas of the substrate or anodized aluminum coating can also have high surface energy, and a surfactant would facilitate deposition of the composition during the subsequent steps.

Other nonessential components which may be present in solution include a buffer to control or maintain pH, as well as alkaline earth cations such as $Mg^{2+}$, $Ca^{2+}$, and $Sr^{2+}$ which precipitate free fluoride. Impurities that can reduce corrosion inhibition, and should be minimized where possible, include chlorides, sulfates, iron, copper, and other cations that are more noble than the aluminum substrate. Halogen anion concentration in the composition are to be minimized to the extent possible, generally preferred to be maintained below a total anion concentration of 0.1 millimolar (mM).

Most broadly, the corrosion inhibitors making up the corrosion inhibitor formulation are at least partially soluble in water. Anodic corrosion inhibitor(s) can be selected from a group consisting of: a molybdate compound, a silicate compound, a phosphate compound, an orthophosphate compound, and combinations thereof. The molybdate and silicate compounds would most frequently be paired with zinc, calcium and/or magnesium cations. Other options or combinations can include a phosphate or orthophosphate silicate compound, a phosphate or orthophosphate silicate hydrate compound, a phosphate or orthophosphate silicate hydrate compound. Any of these phosphate or orthophosphate variants can include at least one of zinc, calcium, strontium, and aluminum cations, and combinations thereof.

Example cathodic corrosion inhibitor(s) can include rare earth salt(s) of one or more carboxylic acids, such as but not limited to citrates. Potential constituents of the rare earth salt(s) can include cerium ions, lanthanum ions, or other rare earth ions compatible with the particular carboxylate. One non-limiting example of a corrosion inhibitor formulation can include a combination of at least zinc molybdate, cerium (III) citrate, and magnesium silicate.

The oxidant can be selected generally from a group consisting of: a permanganate, a peroxide, a persulfate, a percarbonate, a perborate, and combinations thereof.

In addition to the corrosion inhibitors and oxidants above, the water soluble compound can be selected from a group consisting of: a poly-amine compound, a polyol compound, a poly-thiol compound, and combinations thereof. In certain embodiments, the organic complexing agent can be selected from a group consisting of: a phytate, an ethylenediaminetetraacetic acid (EDTA), a thiourea, a benzotriazole, a nitrilotriacetic acid, a citric acid, a polycarboxylic acid, and combinations thereof.

Overall, a concentration of each of these components added to water to form the aqueous solution (corrosion inhibitor formulation, water soluble polymer, organic complexing agent, and oxidant) is initially provided to be in a range of 1-50 millimolar (mM). This concentration range of one or more of the components can be maintained throughout the sealing process (step 106), and a solution pH can be maintained between 3 and 9 (step 108). In certain embodiments, concentration of one or more of the components can be maintained in a range of 1-10 mM and/or the solution pH can be maintained between 4 and 6. The concentrations and/or pH range of the solution can be maintained in part or entirely through use of a buffer as the reaction(s) progress.

Thus, for an otherwise conventional TCP sealed anodized Al alloy part, the post treatment (i.e., second step of two-step sealing process) involves dipping the sealed surface(s) for 30 seconds to 20 minutes in an anodic corrosion inhibitor solution such as is described herein, while maintaining a process temperature in a range of 20° C. to 80° C. In certain embodiments, the process temperature range is 20° C. to 50° C. Contact time may be varied to control the extent of sealing; short contact times can provide moderate sealing for superior adhesion of subsequently—applied organic coatings while longer contact times provide more complete sealing for the protection of components that will not be subsequently coated. Process temperature is dependent on the sealing solution selected and the degree of sealing desired. Typically, greater temperature permits faster sealing. The length of time at a given temperature determines the degree of sealing which is determined by specific application requirements.

The process can greatly improve corrosion protection properties over the conventional TCP sealant. Certain processes may utilize certain of the disclosed classes of corrosion inhibitors, but in the absence of other constituents do not achieve the same result. Further, such inhibitors are applied during the chromating step, resulting in a single step sealing process. For example, certain corrosion inhibitors, applied at the same time as a trivalent chromium composition (i.e., in a single step), result in conversion of a substantial portion of the trivalent chromium into hexavalent chrome (Hex-Cr). However the presence of Hex-Cr, even when formed indirectly by combination of TCP precursors with permanganate or certain other oxidants such as hydrogen peroxide in a single-step sealing process, nevertheless undermines the goal of eliminating hexavalent chrome from industrial processes due to its well-known toxicity and negative environmental effects.

In contrast, the synergy of the components in the disclosed post treatment composition is believed to build, in combination with the TCP previously applied to the anodized surface(s), a better physical barrier to isolate the base/substrate metal from the environment. This is in addition to the corrosion inhibitive reaction on any defects in the anodized aluminum and TCP layers. The oxidant in the disclosed post treatment composition appears to enhance corrosion resistance by activating both cathodic and anodic corrosion inhibitive behavior of the other components in the disclosed post treatment composition, as well as around the anodized aluminum coating barrier layer.

Discussion of Possible Embodiments

A sealant composition assembly according to an exemplary embodiment of this disclosure consists essentially of a corrosion inhibitor formulation, a water soluble polymer, an organic complexing agent, an oxidant, and water. The corrosion inhibitor formulation is formulated from at least one anodic corrosion inhibitor compound, at least one cathodic corrosion inhibitor compound, or a combination thereof. A concentration of each of the corrosion inhibitor formulation, the water soluble polymer, the organic complexing agent, and the oxidant is each in a range of 1-50 mM.

The assembly of the preceding paragraph can optionally include any one or more of the following features, configurations and/or additional components:

A further embodiment of the foregoing composition, wherein the at least one anodic corrosion inhibitor compound is selected from a group consisting of: a molybdate compound, a silicate compound, a phosphate compound, an orthophosphate compound, and combinations thereof.

A further embodiment of any of the foregoing compositions, wherein the molybdate compound or the silicate compound comprise zinc cations, calcium cations, magnesium cations, or combinations thereof.

A further embodiment of any of the foregoing compositions, wherein the phosphate compound or the orthophosphate compound comprise zinc cations, calcium cations, strontium cations, aluminum cations, or combinations thereof.

A further embodiment of any of the foregoing compositions, wherein the at least one cathodic corrosion inhibitor compound comprises a rare earth salt of an organic carboxylic acid.

A further embodiment of any of the foregoing compositions, wherein the rare earth salt comprises cerium ions, lanthanum ions, citrate ions and combinations thereof.

A further embodiment of any of the foregoing compositions, wherein the corrosion inhibitor formulation consists essentially of zinc molybdate, cerium (III) citrate, and magnesium silicate.

A further embodiment of any of the foregoing compositions, wherein the water soluble polymer is selected from a group consisting of: a poly-amine compound, a polyol compound, a poly-thiol compound, and combinations thereof.

A further embodiment of any of the foregoing compositions, wherein the organic complexing agent is selected from a group consisting of: a phytate, an EDTA, a thiourea, a benzotriazole, a nitrilotriacetic acid, a citric acid, a polycarboxylic acid, and combinations thereof.

A further embodiment of any of the foregoing compositions, wherein the oxidant is selected from a group consisting of: a permanganate, a peroxide, a persulfate, a percarbonate, a perborate, and combinations thereof.

A further embodiment of any of the foregoing compositions, wherein a pH of the composition is between 3 and 9.

A further embodiment of any of the foregoing compositions, wherein the pH of the composition is between 4 and 6.

A method according to an exemplary embodiment of this disclosure, among other possible things, includes providing a workpiece with at least one surface having an anodized aluminum coating and a trivalent chromium sealant. The at least one surface of the workpiece is submerged in a post-treatment sealant solution for 0.5 to 20 minutes. The sealant composition comprises a corrosion inhibitor formulation, a water soluble polymer, an organic complexing agent, an oxidant, and water. The corrosion inhibitor formulation is formulated from at least one anodic corrosion inhibitor compound, at least one cathodic corrosion inhibitor compound, or a combination thereof. A concentration of each of the corrosion inhibitor formulation, the water soluble polymer, the organic complexing agent, and the oxidant is each in a range of 1-50 mM.

The method of the preceding paragraph can optionally include any one or more of the following features, configurations and/or additional components:

A further example of the foregoing method, wherein the at least one anodic corrosion inhibitor compound is selected from a group consisting of: a molybdate compound, a silicate compound, a phosphate compound, an orthophosphate compound, and combinations thereof, and the at least one cathodic corrosion inhibitor compound comprises a rare earth salt of an organic carboxylic acid.

A further embodiment of any of the foregoing methods, wherein the molybdate compound or the silicate compound comprise zinc cations, calcium cations, magnesium cations, or combinations thereof, and the phosphate compound or the orthophosphate compound comprise zinc cations, calcium cations, strontium cations, aluminum cations, or combinations thereof.

A further embodiment of any of the foregoing methods, wherein the rare earth salt comprises cerium ions, lanthanum ions, citrate ions, or combinations thereof.

A further embodiment of any of the foregoing methods, wherein the corrosion inhibitor formulation consists essentially of zinc molybdate, cerium (III) citrate, and magnesium silicate.

A further embodiment of any of the foregoing methods, wherein the water soluble polymer is selected from a group consisting of: a poly-amine compound, a polyol compound, a poly-thiol compound, and combinations thereof, and the organic complexing agent is selected from a group consisting of: a phytate, an EDTA, a thiourea, a benzotriazole, a nitrilotriacetic acid, a citric acid, a polycarboxylic acid, and combinations thereof.

A further embodiment of any of the foregoing methods, wherein the oxidant is selected from a group consisting of: a permanganate, a peroxide, a persulfate, a percarbonate, a perborate, and combinations thereof.

A further embodiment of any of the foregoing methods, further comprising: maintaining a pH of the composition in a range between 3 and 9, and maintaining a process temperature in a range of 20° C. to 80° C.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A sealant composition consisting essentially of:
a corrosion inhibitor formulation;
a water soluble polymer;
an organic complexing agent;
an oxidant; and
water;
wherein the corrosion inhibitor formulation is formulated from at least one anodic corrosion inhibitor compound, at least one cathodic corrosion inhibitor compound, or a combination thereof;
and wherein a concentration of each of the at least one anodic corrosion inhibitor compound, the at least one cathodic corrosion inhibitor compound, or the combination thereof, the corrosion inhibitor formulation, the water soluble polymer, the organic complexing agent, and the oxidant is each in a range of 1-50 mM based on the sealant composition.

2. The composition of claim 1, wherein the at least one anodic corrosion inhibitor compound is selected from a group consisting of: a molybdate compound, a silicate compound, a phosphate compound, an orthophosphate compound, and combinations thereof.

3. The composition of claim 2, wherein the molybdate compound or the silicate compound comprise zinc cations, calcium cations, magnesium cations, or combinations thereof.

4. The composition of claim 2, wherein the phosphate compound or the orthophosphate compound comprise zinc cations, calcium cations, strontium cations, aluminum cations, or combinations thereof.

5. The composition of claim 1, wherein the at least one cathodic corrosion inhibitor compound comprises a rare earth salt of an organic carboxylic acid.

6. The composition of claim 5, wherein the rare earth salt comprises cerium ions, lanthanum ions, citrate ions and combinations thereof.

7. The composition of claim 2, wherein the corrosion inhibitor formulation consists essentially of zinc molybdate, cerium (III) citrate, and magnesium silicate.

8. The composition of claim 1, wherein the water soluble polymer is selected from a group consisting of: a poly-amine compound, a polyol compound, a poly-thiol compound, and combinations thereof.

9. The composition of claim 8, wherein the organic complexing agent is selected from a group consisting of: a phytate, an EDTA, a thiourea, a benzotriazole, nitrilotriacetic acid, citric acid, a polycarboxylic acid, and combinations thereof.

10. The composition of claim 9, wherein the oxidant is selected from a group consisting of: a permanganate, a peroxide, a persulfate, a percarbonate, a perborate, and combinations thereof.

11. The composition of claim 10, wherein a pH of the sealant composition is between 3 and 9.

12. The composition of claim 11, wherein the pH of the sealant composition is between 4 and 6.

13. A method comprising:

providing a workpiece with at least one surface having an anodized aluminum coating and a trivalent chromium sealant;

submerging the at least one surface of the workpiece in a post-treatment sealing solution for 0.5 to 20 minutes, the sealing solution comprising: a corrosion inhibitor formulation;

a water soluble polymer;

an organic complexing agent;

an oxidant; and water;

wherein the corrosion inhibitor formulation is formulated from at least one anodic corrosion inhibitor compound, at least one cathodic corrosion inhibitor compound, or a combination thereof;

and wherein a concentration of each of the at least one anodic corrosion inhibitor compound, the at least one cathodic corrosion inhibitor compound, or the combination thereof, the corrosion inhibitor formulation, the water soluble polymer, the organic complexing agent, and the oxidant is each in a range of 1-50 mM based on the sealant composition.

14. The method of claim 13, wherein the at least one anodic corrosion inhibitor compound is selected from a group consisting of: a molybdate compound, a silicate compound, a phosphate compound, an orthophosphate compound, and combinations thereof, and the at least one cathodic corrosion inhibitor compound comprises a rare earth salt of an organic carboxylic acid.

15. The method of claim 14, wherein the molybdate compound or the silicate compound comprise zinc cations, calcium cations, magnesium cations, or combinations thereof, and the phosphate compound or the orthophosphate compound comprise zinc cations, calcium cations, strontium cations, aluminum cations, or combinations thereof.

16. The method of claim 14, wherein the rare earth salt comprises cerium ions, lanthanum ions, citrate ions, or combinations thereof.

17. The method of claim 14, wherein the corrosion inhibitor formulation consists essentially of zinc molybdate, cerium (III) citrate, and magnesium silicate.

18. The method of claim 14, wherein the water soluble polymer is selected from a group consisting of: a poly-amine compound, a polyol compound, a poly-thiol compound, and combinations thereof, and the organic complexing agent is selected from a group consisting of: a phytate, an EDTA, a thiourea, a benzotriazole, a nitrilotriacetic acid, a citric acid, a polycarboxylic acid, and combinations thereof.

19. The method of claim 18, wherein the oxidant is selected from a group consisting of: a permanganate, a peroxide, a persulfate, a percarbonate, a perborate, and combinations thereof.

20. The method of claim 19, further comprising:

maintaining a solution pH in a range between 3 and 9; and maintaining a process temperature in a range of 20° C. to 80° C.

* * * * *